US010139192B1

(12) United States Patent
Baghadjian et al.

(10) Patent No.: US 10,139,192 B1
(45) Date of Patent: Nov. 27, 2018

(54) AIRSOFT MAGAZINE

(71) Applicants: Marc Baghadjian, Denver, CO (US); Jonathan Lustig, Stamford, CT (US)

(72) Inventors: Marc Baghadjian, Denver, CO (US); Jonathan Lustig, Stamford, CT (US)

( * ) Notice: Subject to any disclaimer, the term of this patent is extended or adjusted under 35 U.S.C. 154(b) by 0 days.

(21) Appl. No.: 15/846,398

(22) Filed: Dec. 19, 2017

(51) Int. Cl.
*F41B 11/57* (2013.01)
*F41B 11/55* (2013.01)

(52) U.S. Cl.
CPC ..... *F41B 11/57* (2013.01); *F41B 11/55* (2013.01)

(58) Field of Classification Search
CPC ..... F41B 11/53; F41B 11/55; F41B 11/57; F41B 11/71
USPC ..... 124/45, 49, 51.1, 52
See application file for complete search history.

(56) References Cited

U.S. PATENT DOCUMENTS 5,282,454 A * 2/1994 Bell ..... F41A 9/48 124/49
6,305,367 B1 * 10/2001 Kotsiopoulos ..... F41B 11/57 124/49
6,415,781 B1 * 7/2002 Perrone ..... F41B 11/57 124/49
6,467,473 B1 * 10/2002 Kostiopoulos ..... F41B 11/57 124/51.1
6,481,432 B2 * 11/2002 Rushton ..... F41B 11/57 124/49
8,156,930 B2 * 4/2012 Hu ..... F41A 17/36 124/51.1
9,038,304 B1 * 5/2015 Hu ..... F41A 9/71 42/49.01
9,151,564 B1 * 10/2015 Baxter ..... F41A 33/00
9,273,925 B1 * 3/2016 Liao ..... F41A 17/36
9,835,403 B2 * 12/2017 Kang ..... F41B 11/55
9,952,015 B2 * 4/2018 Kang ..... F41A 17/36
2006/0042613 A1 * 3/2006 Hu ..... F41B 11/54 124/48
2008/0236558 A1 * 10/2008 Bosch ..... F41B 11/57 124/48
2009/0133680 A1 * 5/2009 Christopher ..... F41B 11/57 124/51.1
2011/0030667 A1 * 2/2011 Lin ..... F41B 11/55 124/52
2012/0160225 A1 * 6/2012 Cho ..... F41A 9/67 124/52
2014/0041646 A1 * 2/2014 Middlebrook ..... F41B 11/53 124/51.1

(Continued)

*Primary Examiner* — Alexander Niconovich
(74) *Attorney, Agent, or Firm* — Daniel M. Cohn; Howard M. Cohn

(57) ABSTRACT

An airsoft magazine that provides an automated feed mechanism of pellets housed in the magazine. The airsoft magazine includes an outer shell housing an inner shell, the inner shell constructed of two symmetrical, half shells. The inner shell includes a feed mechanism operated by a motor powered by a battery. The feed mechanism includes a spinning gear mechanism rotated by the motor to transfer the pellets from a loading chamber to an exit chamber from which the pellets are ejected from the magazine. A first sensor is disposed in the inner shell to output a signal when the sensor detects the pellets passing through the exit chamber and ejected from the magazine. A circuit board for receiving the signal from the sensor turns on the motor and transfers the pellets from the loading chamber to the exit chamber from which the pellets are ejected from the magazine.

19 Claims, 3 Drawing Sheets

(56) References Cited

U.S. PATENT DOCUMENTS

| | | | | |
|---|---|---|---|---|
| 2017/0176130 | A1* | 6/2017 | Kang | F41B 11/55 |
| 2017/0276451 | A1* | 9/2017 | Kang | F41A 17/36 |

* cited by examiner

AIRSOFT MAGAZINE

TECHNICAL FIELD OF THE INVENTION

The present invention relates to an improved airsoft magazine, and more particularly to an airsoft magazine that provides an automated feed mechanism of pellets housed in the magazine

BACKGROUND OF THE INVENTION

Many people enjoy the excitement experienced in a war or survival game and they always use airsoft guns and projectiles of plastic ball or paintball to imitate real gun and bullet that present real life-threatening dangers and under strict control. Multiple projectiles are loaded in a magazine to be fired one by one by the airsoft gun.

Airsoft guns use an expanding gas, such as compressed air or carbon dioxide (CO2) to propel plastic pellets through the barrel. Airsoft guns can fire in rapid succession a relatively large number of plastic pellets in a short period of time. A magazine stores the plastic pellets until the balls are delivered to the gun firing chamber. The guns use compressed gas as the propellant, and are usually triggered by a user squeezing a conventionally shaped gun trigger. When the gun user repeatedly squeezes the trigger, the gun should continue to fire plastic pellets as rapidly as possible. Airsoft guns most are either semi-automatic, where each time the trigger is pulled a plastic pellet is fired, or fully automatic, where the balls are fired as quickly as the gun is capable of for as long as the trigger is pulled.

Plastic pellets are relatively round and have an exterior formed from a semi-rigid gelatinous compound. The gelatinous compound is known to be affected somewhat by variables such as temperature and relative humidity. During a firing sequence, plastic pellets on occasion lodge against each other or other objects and block the passageway to the firing chamber, resulting in a jam. While jamming is not new, knowledge from explosive munitions magazines is of little use with the very different plastic pellets.

SUMMARY OF THE INVENTION

According to an embodiment of the present invention, there is disclosed an airsoft magazine that provides an automated feed mechanism of pellets housed in the magazine. The airsoft magazine includes an outer shell housing an inner shell, the inner shell constructed of two symmetrical, half shells. The inner shell includes a feed mechanism operated by a motor powered by a battery. The feed mechanism includes a spinning gear mechanism rotated by the motor to transfer the pellets from a loading chamber within the inner shell to an exit chamber from which the pellets are ejected from the magazine. A first sensor is disposed in the inner shell to output a signal when the sensor detects the pellets passing through the exit chamber to be ejected from the magazine. A circuit board for receiving the signal from the sensor turns on the motor and transfers the pellets from the loading chamber to the exit chamber from which the pellets are ejected from the magazine.

According to another embodiment of the present invention, there is disclosed a method of providing an automated feed mechanism for an airsoft magazine. The method includes housing an inner shell within an outer shell, the inner shell constructed of two symmetrical, half shells. Operating a feed mechanism by a motor and powering the motor with a battery. Rotating a spinning gear mechanism by the motor and transferring the pellets from a loading chamber within the inner shell to an exit chamber from which the pellets are ejected from the magazine. Disposing a first sensor in the inner shell for outputing a signal when the sensor detects the pellets passing through the exit chamber to be ejected from the magazine. Finally, receiving the signal with a circuit board from the sensor for turning on the motor and transferring the pellets from the loading chamber to the exit chamber from which the pellets are ejected from the magazine.

BRIEF DESCRIPTION OF THE DRAWINGS

The structure, operation, and advantages of the present invention will become further apparent upon consideration of the following description taken in conjunction with the accompanying figures (Figs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

DETAILED DESCRIPTION OF THE PREFERRED EMBODIMENTS

Figure 1:
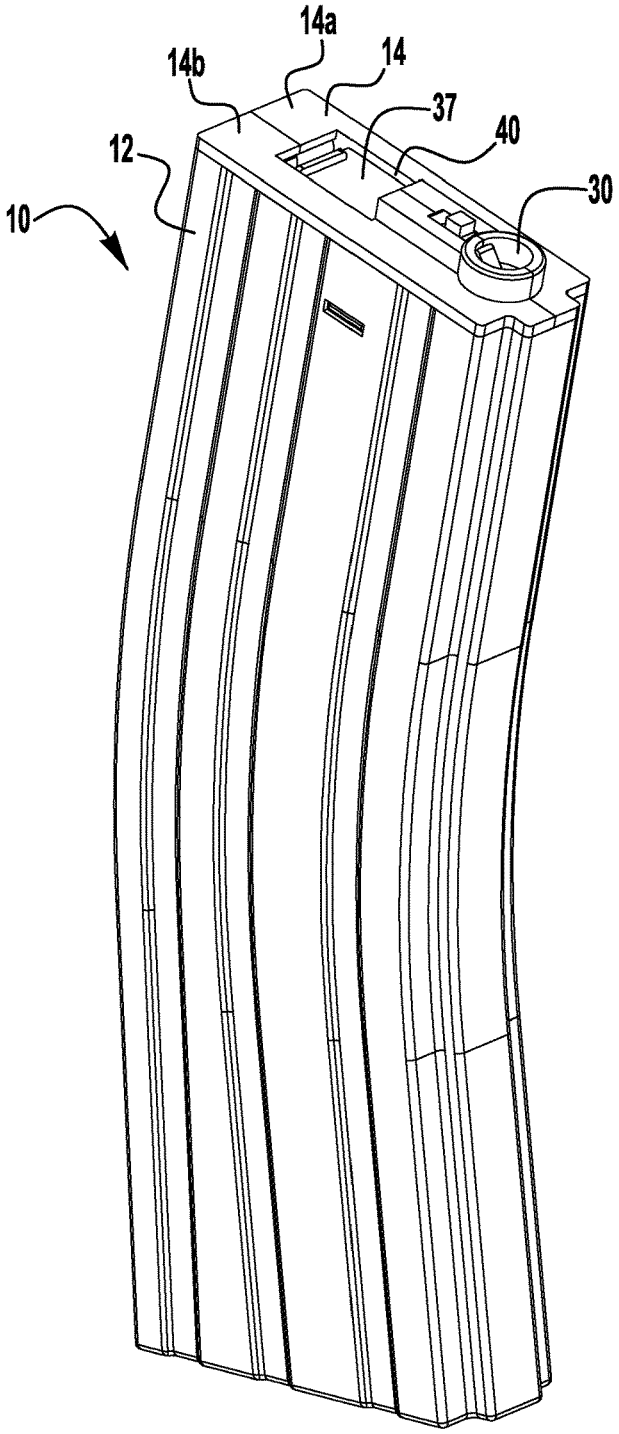
FIG. 1 is a front, three dimensional view of the improved airsoft magazine, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

Figure 2:
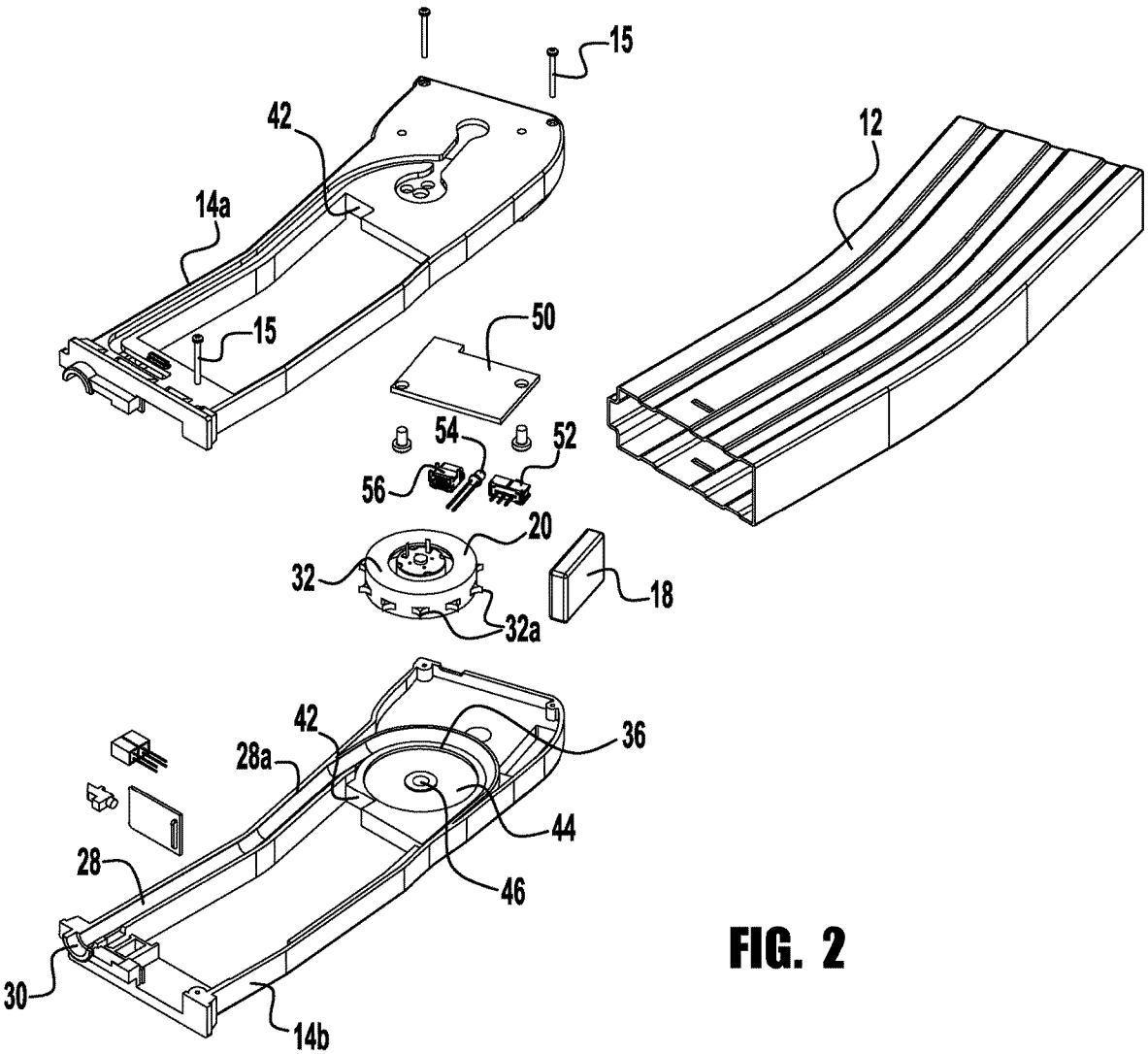
FIG. 2 is a top, three dimensional exploded view of the improved airsoft magazine, illustrating the various internal components, in accordance with the present invention.

The improved airsoft magazine 10, as shown in FIG. 1, is a high-capacity airsoft magazine that provides an automated feed mechanism of pellets housed in the magazine creating a hands-free airsoft experience. The magazine 10 is constructed of an outer shell 12, as shown in FIG. 2, which houses an inner shell 14 constructed of two symmetrical, half shells 14*a* and 14*b* which can be secured to each other with threaded screws 15. Once the inner shell 14 is constructed, it can be inserted within the outer shell 12 as shown in FIG. 1.

Figure 3:
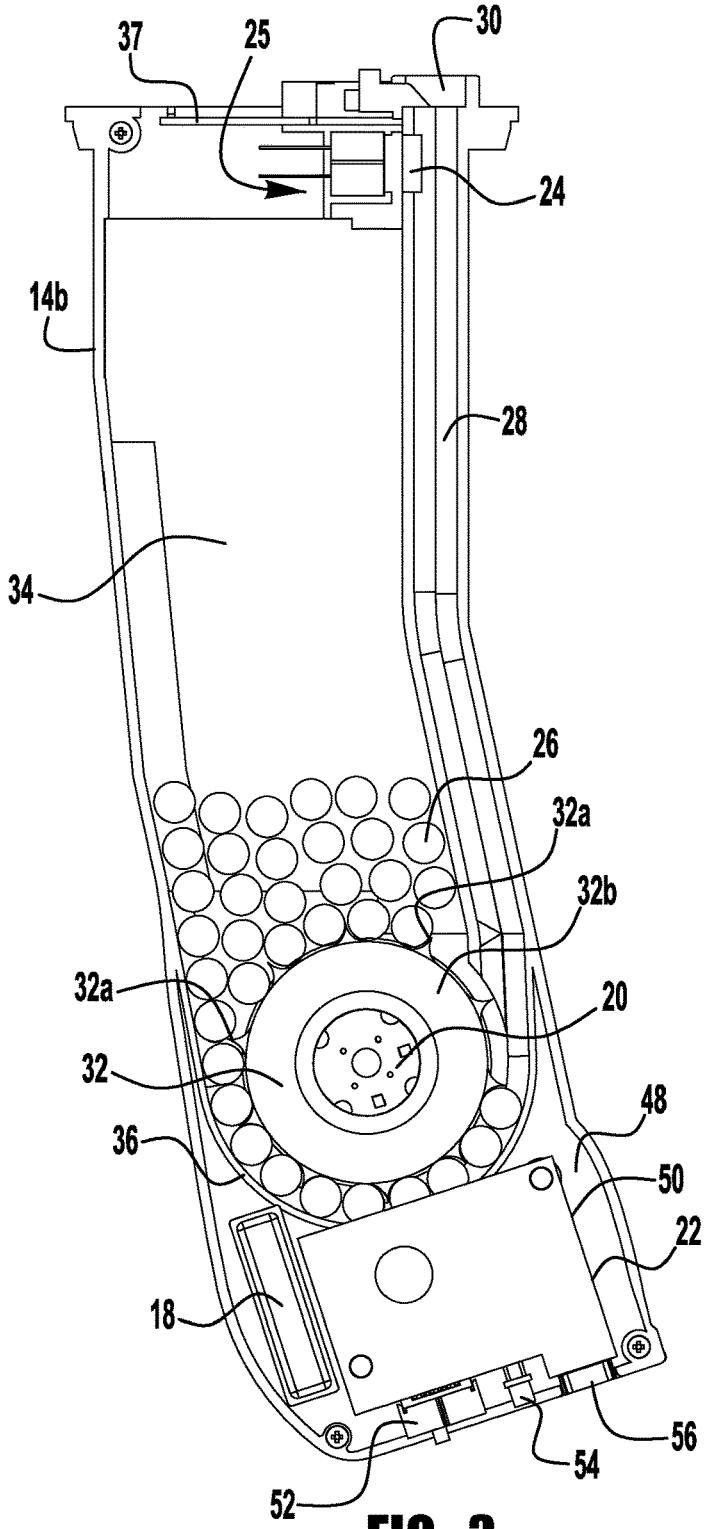
FIG. 3 is a front, three dimensional view of the improved airsoft magazine, illustrating the various internal components and pellets within the magazine, in accordance with the present invention.

In broad terms, the airsoft magazine 10, as shown in the exploded view of FIG. 2, incorporates a feed mechanism 16, including a battery 18, a motor 20, a circuit board 22 and a first sensor 24, such as a warren screw, to detect when pellets or other types of projectiles 26 are being ejected from the magazine 10 through an exit chamber 28. When the sensor 24 detects the pellets 26 passing through the exit chamber 28 and out through the exit opening 30, a signal is sent through a circuit (not shown) formed of wiring in the inner shell 14 to the circuit board 22 as shown in FIG. 3, which turns on the motor 20 which is powered by the battery 18. The spinning movement of the motor 20 rotates a gear mechanism 32 disposed around the motor 20. The gear mechanism 32 has a plurality of teeth 32*a* projecting outward there from, as discussed hereinafter, to engage the pellets 26 and transfer them from a loading chamber 34 within the inner shell 14 to an exit chamber 28. The rotation of the gear mechanism 32 causes the pellets to move through a channel 36 beginning at the side of the gear mechanism opposite the exit chamber 28, circling below the gear mechanism 32 and connecting to the inlet 28*a* of the exit chamber 28.

A release hatch 37 covering the inlet 40 to the loading chamber 34 is spring loaded with a spring 38. When the release hatch is closed as shown in FIG. 1, it can be engaged by the trigger (not shown) of the airsoft gun which causes the spring 38 to compress and in conjunction with a second sensor 25, send a signal to the circuit board which turns on the motor 20 that is powered by the battery 18. This in turn transfers the pellets 26 them from the loading chamber 34 to the exit chamber 28 so that they can be fed into the airsoft gun.

When the spring 38 is not being compressed by the trigger, the sensor 24 will no longer detect the pellets 26 passing through the exit chamber 28 and out through the exit opening 30. At that point, the signal previously sent through the circuit formed of wiring in the inner shell 14 to the circuit board 22 turns off the motor 20 and the pellets are not longer transferred them from the loading chamber 34 to the exit chamber 28. At this point, the spring 38 can be compressed to open the inlet 40 to the chamber 34 so that pellets 26 can be added to the loading chamber 34 without activating the motor 20.

This automated feature of feeding the pellets into the exit chamber 28, completely removes the need to reload the pellets 26 from the loading chamber 34 and to turn the gear mechanism 32 to move them from the loading chamber into the exit chamber 28. The ability of the magazine 10 to automatically reload the pellets 26 from the loading chamber 34 to the exit chamber 28, reduces the need and frequency for manual reloading. This automation provides for the storage and dispensing of a larger pool of pellets, such as for example four hundred or more pellets, capable of more continuous, uninterrupted firing from an airsoft gun incorporating the magazine 10 of the present invention. The rearming ability of the magazine 10 of the present invention saves lost game time caused by the need to constantly reload the exit chamber 28, by automatically moving the pellets from the loading chamber 34 to the exit chamber 28 and thereby allows for more play time.

The release hatch 37 is connected to the circuit board 22 via copper wires, which in turn connect to the motor 20. The release hatch 37 maybe constructed of Kevlar textile. Release hatch 37, as shown in FIGS. 1 and 3, is in a default closed position, until it is opened with the trigger of the airsoft gun thereby causing the movement of pellets 26 from the loading chamber 34 to the exit chamber 28, previously discussed.

Directly below the release hatch 37 is a molded plastic, internal loading chamber 34, defined between the two symmetrical half inner shells 14*a* and 14*b* forming the inner shell 14. The loading chamber 34 houses the pellets 26, as seen in FIG. 3, typically up to 350 pellets. The internal loading chamber 34 is specifically molded with a funnel shaped outlet 42 connected to the entrance channel 36 for directing pellets 26 into the channel 36 and then to the exit chamber 28.

The pellets 20 are stored within the loading chamber 34, until they are ready to be loaded into the adjacent firing chamber 28 for purposes of firing. As described below, the sensor 24 determines when the firing chamber 28 is empty, and in turn causes the motor 20 to turn on and distribute the pellets 26 from the loading chamber 34, into the firing chamber 28.

Below the loading chamber 34 is the gear mechanism 32. The gear mechanism 32 is received within a circular shaped depression 44 in the inner shell 11*b*. The gear mechanism 32 is composed of a wheel 32*b* with teeth 32*a*. The wheel 32*b* is designed to be mounted securely in the circular shaped depression 44. When the motor 20 receives instruction to replenish the firing chamber 28, the gear mechanism 32 rotates. Individual pellets 26 exit the loading chamber 34 through the entrance channel 36, where they are rotated about the gear mechanism 32 on each of the teeth 32*a*, as seen in FIG. 3. The gear mechanism 32 disposes each of the pellets 26 into the firing chamber 28.

The battery 18, the motor 20, and circuit board 22 are housed within storage component 48, at the bottom section of the inner shell 14, and formed between the two symmetrical half inner shells 14*a* and 14*b*. The battery 18, motor 20, and circuit board 22 are preferably mounted to the inner shell 14*b*, and secured within the storage component 48 with a cover 50. The battery 18 may be any appropriate desired size, such as a 3 Volt DC battery. The motor 20, which has the function of rotating the gear mechanism 32, is preferably a DC volt operated, nano-motor, typically restricted to one direction rotation. The circuit board 22 is a non-complex, mini-electric circuit board, with an On/Off circuit.

In use, the user engages the trigger of the gun, thereby pressing the release hatch 37. This in turn sends a signal to the circuit board 22, forming a closed electric circuit loop to enable the flow of electricity to the preferably a DC volt operated nano-motor 20, thus activating it. The DC nano-motor 20 starts rotating at a high rate of speed, typically up to 2400 Revolutions Per Minute (RPM).

The DC nano-motor 20 is connected via a worm gear (not shown) to the gear mechanism 32, which starts a pull/push motion of the spring 38 with a loading plate. Then, the loading plate pushes the pellets 26 into the firing chamber 28, forcing the pellets into the outlet tube 28 just adjacent the release hatch 37, and pushes the pellets into the soft gun in single file, as the release hatch opens. When the user releases the trigger, the release hatch 37 closes, causing the electric circuit to enter an open mode. In turn, the electric current is discontinued, causing the DC nano-motor 20 to stop. The pellets 26 remain in a single file within the firing chamber 28 ready for immediate firing when the trigger is pulled again.

Should the battery power run out during operation or should the motor malfunction in any way during operation, the user will be able to unlatch the Kevlar cloth release latch 37 and manually spin the gear 32 to feed the pellets 26 into the funnel tube 42 manually by rolling the gear 32 with a finger or two. When the spring 38 has 65 pascals (hereinafter "Pa") of pressure on it, it senses that the firing chamber 28 is full—keeping the circuit to the motor open (unpowered). For example, once it measures that the pressure is less than 65 Pascals—(x<65 Pa)—it will close the circuit thus powering the motor 20. The motor 20 would spin, feeding more bullets into the sensor until it would reach 65 Pa of pressure. When the sensor 24 notes that the firing chamber is not full—it will spin the motor 20 which will thus take pellets 26 from the loading chamber 34 to the firing chamber 28.

As shown in FIG. 3, a power switch 52 can be used to turn the power to the airsoft magazine 10. An LED 54 can be incorporated in the circuitry to indicate if the power to the magazine 10 is on. Also a USB outlet 56 can be incorporated in the bottom of the magazine to provide power to the airsoft magazine 10, if desired.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. An airsoft magazine that provides an automated feed mechanism of pellets housed in the magazine, comprising;
- an outer shell;
  - an inner shell constructed of two symmetrical, half shells which are secured to each other and inserted into the outer shell;
- the inner shell including a feed mechanism operated by a motor powered by a battery;
- the feed mechanism including a spinning gear mechanism with a plurality of teeth rotated by the motor to transfer the pellets from a loading chamber disposed above the feed mechanism within the inner shell to an exit chamber from which the pellets are ejected from the magazine;
  - a first sensor disposed in the inner shell to output a first signal to a circuit board to turn on the motor when the first sensor detects the pellets passing through the exit chamber to be ejected from the magazine;
  - a release hatch covering an inlet to the loading chamber being spring loaded with a spring which when compressed sends a second signal output from a second sensor to the circuit board which when the first signal is output to the circuit board turns on the motor to transfer the pellets from the loading chamber to the exit chamber; and
  - the battery, motor, and circuit board being mounted to the inner shell and secured within a storage component disposed at a bottom section of the inner shell and secured within the storage component with a cover.

2. The airsoft magazine of claim 1, wherein an inlet through which the pellets are loaded into the loading chamber being covered by a normally closed spring loaded release hatch and the release hatch being open when the pellets are loaded into the loading chamber.

3. The airsoft magazine of claim 2, wherein when the release hatch is closed, it can be engaged by a trigger causing the spring closing the spring loaded release hatch to compress whereby the second sensor sends the second signal to the circuit board, turning on the motor to transfer the pellets from the loading chamber to the exit chamber from which the pellets are ejected from the magazine.

4. The airsoft magazine of claim 3, further including when the spring is not being compressed by the trigger, and the first sensor is no longer detecting the pellets passing through the exit chamber and out through the exit opening the first signal to the circuit board is stopped and the motor is turned off.

5. The airsoft magazine of claim 3, further including the motor being turned off when the spring is compressed to open the release hatch to the inlet to the chamber so pellets can be added to the loading chamber while the first sensor does not detect the pellets passing through the exit chamber.

6. The airsoft magazine of claim 3, further including the release hatch being connected to the circuit board via copper wires, and wherein the copper wires connect the circuit board to the motor.

7. The airsoft magazine of claim 1, further including the loading chamber being disposed between the two symmetrical half inner shells and the loading chamber has a funnel shaped outlet.

8. The airsoft magazine of claim 7, wherein the funnel shaped outlet of the loading chamber is connected to an entrance channel for directing pellets from the loading chamber into the exit chamber.

9. The airsoft magazine of claim 8, further including the pellets, which have exited the loading chamber through the entrance channel, rotating about the gear mechanism on the teeth.

10. The airsoft magazine of claim 1, wherein the gear mechanism is mounted to the motor and is comprised of a wheel with teeth projecting outward therefrom.

11. The airsoft magazine of claim 1, wherein the motor is a DC volt operated, nano-motor, restricted to one direction rotation.

12. The airsoft magazine of claim 11, wherein the circuit board is a non-complex, mini-electric circuit board, with an On/Off circuit.

13. The airsoft magazine of claim 1, further including a power switch to turn on the power to the motor within the airsoft magazine and an LED to indicate if the power to the motor is on.

14. The airsoft magazine of claim 1, further including a USB outlet in the bottom section of the magazine to provide power to the airsoft magazine.

15. A method of providing an automated feed mechanism for an airsoft magazine, comprising;
- housing an inner shell within an outer shell, the inner shell constructed of two symmetrical, half shells;
- operating a feed mechanism by a motor and powering the motor with a battery wherein the motor and battery are disposed in the inner shell;
- rotating a spinning gear mechanism by the motor and transferring the pellets from a loading chamber within the inner shell to an exit chamber from which the pellets are ejected from the magazine;

disposing a first sensor in the inner shell for outputing a first signal when the first sensor detects the pellets passing through the exit chamber to be ejected from the magazine;

providing a release hatch covering an inlet to the loading chamber being spring loaded with a spring;

compressing the spring and sending a second signal from a second sensor to the circuit board, which when the first signal is output to the circuit board, turning on the motor for transferring transfer the pellets from the loading chamber to the exit chamber; and receiving the first and second signals with the circuit board from the first and second sensors for turning on the motor and transferring the pellets from the loading chamber to the exit chamber from which the pellets are ejected from the magazine.

16. The method of claim 15 further including loading the pellets through the inlet into the loading chamber being covered by the release hatch and opening the release hatch when the pellets are loaded into the loading chamber.

17. The method of claim 16 further including engaging a trigger causing the spring closing the release hatch to compress whereby the second sensor signaling to the circuit board, turning on the motor to transfer the pellets from the loading chamber to the exit chamber from which the pellets are ejected from the magazine.

18. The method of claim 17 further including turning off the motor when the spring is compressed for opening the release hatch to the inlet to the chamber so pellets can be added to the loading chamber while the first sensor does not detect the pellets passing through the exit chamber.

19. The method of claim 18 further including disposing the loading chamber between the two symmetrical half inner shells and the loading chamber having a funnel shaped outlet.

* * * * *